United States Patent [19]

Buchholz

[11] 4,378,640

[45] Apr. 5, 1983

[54] FLUID FLOW DEFLECTOR APPARATUS AND SHEET DRYER EMPLOYING SAME

[76] Inventor: Adolf Buchholz, 11694 SE. Clover La., Portland, Oreg. 97266

[21] Appl. No.: 239,570

[22] Filed: Mar. 2, 1981

[51] Int. Cl.[3] ..... F26B 13/04

[52] U.S. Cl. ..... 34/155; 34/231; 165/109 R

[58] Field of Search ..... 165/109, 172, 76; 34/155, 160, 231, 29, 34; 138/38

[56] References Cited

U.S. PATENT DOCUMENTS

| | | | |
|---|---|---|---|
| 2,070,427 | 2/1937 | Faunce | 165/76 |
| 2,717,049 | 9/1955 | Langford | 165/109 T |
| 3,870,081 | 3/1975 | Kleppe et al. | 138/38 |
| 4,026,037 | 5/1977 | Buchholz | 34/57 R |
| 4,121,350 | 10/1978 | Buchholz | 34/77 |
| 4,127,946 | 12/1978 | Buchholz | 34/28 |
| 4,204,570 | 5/1980 | Eisinger | 165/172 |

FOREIGN PATENT DOCUMENTS

| | | | |
|---|---|---|---|
| 149234 | 5/1903 | Fed. Rep. of Germany | 165/109 T |
| 2547974 | 4/1977 | Fed. Rep. of Germany | 165/172 |
| 1499993 | 9/1967 | France | 165/172 |

*Primary Examiner*—Larry I. Schwartz

*Attorney, Agent, or Firm*—Klarquist, Sparkman, Campbell, Leigh, Whinston & Dellett

[57] ABSTRACT

A fluid flow deflector apparatus is described including a helical shaped deflector member. The deflector member is positioned in the path of a fluid stream, such as hot air, to deflect the flow of such stream thereby producing turbulence to mix the fluid and prevent laminar flow. The deflector member can be positioned with its axis extending substantially parallel to the direction of flow of the fluid stream. Thus, in one embodiment the deflector member is positioned inside a conduit to provide a heat exchanger apparatus in which hot air or other heating fluid is deflected into contact with the inner surface of the conduit in order to heat another fluid in contact with the outer surface of such conduit. In another embodiment of the invention the deflector member is positioned in a sheet dryer apparatus with its axis extending substantially perpendicular to the directional flow of the stream of drying fluid, such as hot air or steam, to deflect the fluid upward and downward into contact with separated sheets being dried. This results in better mixing of the fluid to provide a more uniform temperature and more efficient drying. The sheet dryer apparatus may be a wood veneer dryer, or a gypsum wall-board dryer or insulation board dryer. The helical deflector member provides less resistance to air flow than other deflectors so that the flow increases and the pressure drop decreases which provides a much more efficient heat exchanger or dryer.

14 Claims, 7 Drawing Figures

FLUID FLOW DEFLECTOR APPARATUS AND SHEET DRYER EMPLOYING SAME

BACKGROUND OF INVENTION

The present invention relates generally to fluid flow deflector apparatus and in particular to such deflector apparatus employing a helical or other spiral shaped deflector member to provide more fluid turbulence and reduce laminar fluid flow while producing less resistence to flow and less pressure drop than other deflectors thereby resulting in a more efficient operation.

The fluid flow deflector apparatus of the present invention is especially useful when employed as a heating fluid deflector in a sheet dryer apparatus including a wood veneer dryer, a gypsum wallboard dryer, or insulation board dryer, where it extends substantially perpendicular to the flow of the stream of heating fluid, such as hot air or steam, and deflects such stream upward and downward into contact with separated sheets being dried. This results in better mixing of the heating fluid as well as a higher and more uniform temperature of the portion of such fluid which contacts the sheet material, thereby resulting in a more efficient drying operation. However, the fluid flow deflector apparatus is also useful in heat exchanger apparatus where the axis of the deflector member extends substantially parallel to the direction of fluid flow and such deflector is located either inside or outside a conduit in heat exchanging relationship with another fluid to provide for a more efficient heat exchanger operation. The term "fluid" as used herein refers not only to liquids and gases, but also solid particulate material which flows, such as gypsum powder used to make wallboard.

Previously it has been proposed in my earlier U.S. Pat. No. 4,121,350 of A. Buchholz, issued Oct. 24, 1978 to provide a sheet dryer apparatus using deflector members as flat baffles of rectangular or V-shaped cross-section to deflect the stream of drying fluid such as hot air or steam into contact with the wood veneer or other sheet material being dried for more efficient drying. However, these deflector members provide a high resistence to airflow which increases the pressure drop and reduces airflow within the dryer sections. In addition, they do not deflect the drying fluid in a sideways direction. As a result, there is some laminar airflow and the drying fluid is not mixed as completely so that the temperature of the fluid which contacts the top and bottom of the sheet material is not sufficiently high or uniform throughout the dryer. Thus, a laminar flow of higher temperature air tends to exist in the intermediate region between the sheets while the air which contacts the sheets is of lower temperature and is not very uniform. These problems are overcome using the helical deflector member of the present invention which has a low resistence to airflow and produces little pressure drop as well as more turbulence to eliminate laminar airflow. As a result, there is better mixing of the airflow from side-to-side or top-to-bottom in the space between two adjacent separated sheets being dried and better mixing from deck-to-deck. Thus, the sheet material on the top deck is dried more nearly at the same temperature and moisture content as the sheet material on the bottom deck of the dryer.

In addition, the fluid flow deflector of the invention has other advantages when used in heat exchanger apparatus. Thus, the deflector may be supported within a conduit transmitting heating fluid so that the deflector member is positioned with its axis extending substantially parallel to the direction of fluid flow. When so positioned, the deflector member deflects the stream of hot gas or other heating fluid outwardly into contact with the inner surface of the conduit, which conducts the heat to a surrounding fluid outside of the conduit. The helical deflector member produces greater turbulence, prevents laminar fluid flow and provides a more uniform temperature in the fluid along the surface of the conduit without greatly increasing the resistence to fluid flow within the conduit. Thus, it prevents laminar airflow which tends to cause higher temperature air to flow down the center of the conduit away from its inner surface. In another embodiment the helical deflector member itself may be used as a heat exchanger element such as by welding such deflector member to the outside surface of a conduit, such as a steam pipe, conveying heating fluid for heating the surrounding air or other fluid flowing past the outer surface of such conduit and into contact with such deflector members. In addition, solid particulate fluid material, such as gypsum powder, can be caused to flow over the surfaces of such external deflector members operating as heat exchangers welded to the outside of the conduit through which the heating fluid is supplied, for more efficient drying of such particulate material.

SUMMARY OF INVENTION

It is therefore one object of the present invention to provide an improved fluid flow deflector apparatus of more efficient operation.

Another object of the invention is to provide such a deflector apparatus which produces greater fluid turbulence and eliminates laminar fluid flow for better mixing of the fluid to provide a more uniform temperature in such fluid.

A further object of the invention is to provide such a deflector apparatus with a low resistence to airflow and small pressure drop for greater fluid flow there through.

An additional object of the invention is to provide such a deflector of helical shape in a dryer apparatus to provide more efficient drying of sheet material or solid particulate material.

Still another object of the invention is to provide such a deflector in an improved heat exchanger apparatus for more efficient heat exchange operation by supporting such deflector inside or outside a conduit through which fluid flows in heat exchanging relationship with a second fluid outside of the conduit.

A still further object of the invention is to provide such an improved deflector in a sheet dryer apparatus for better mixing of heated air between adjacent separated sheets and from deck-to-deck in multiple deck dryers for more efficient drying.

An additional object is to provide such an improved sheet dryer apparatus for wood veneer having more uniform drying temperatures to produce dried veneer sheets of higher quality and more uniform moisture content.

DESCRIPTION OF DRAWINGS

Other objects and advantages of the present invention will be apparent from the following detailed description of certain preferred embodiments thereof and from the attached drawings of which.

DESCRIPTION OF PREFERRED EMBODIMENTS

Figures 1, 2, 3, 4, 5, 6, 7:
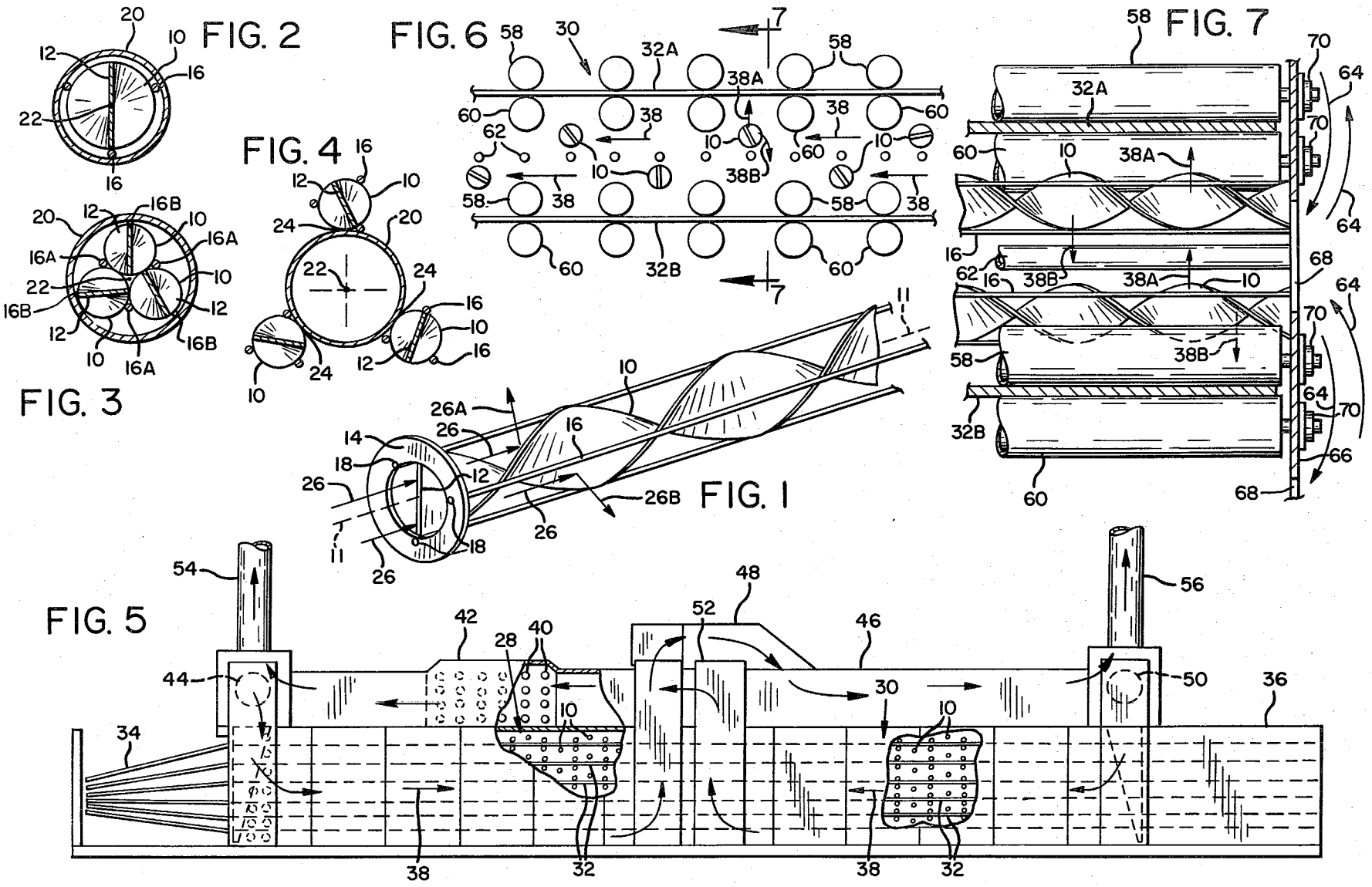
FIG. 1 is a perspective elevation view of the fluid flow deflector apparatus of the present invention.
FIG. 2 is a vertical section view showing the deflector member of FIG. 1 supported with a conduit to provide a first heat exchanger apparatus.
FIG. 3 is a section view showing three of the deflector members of FIG. 1 mounted within a conduit to provide a second heat exchanger apparatus.
FIG. 4 is a section view showing three of the deflector members of FIG. 1 mounted on the outside of a conduit to provide a third heat exchanger apparatus.
FIG. 5 is a side elevation view of a veneer dryer employing fluid flow deflectors made in accordance with the invention, with parts broken away to show internal construction.
FIG. 6 is an enlarged view of a portion of the rear dryer chamber in the dryer of FIG. 1 showing the location of the deflector members.
FIG. 7 is a further enlarged vertical section view taken along line 7—7 of FIG. 6.

As shown in FIG. 1, one embodiment of the fluid flow deflector apparatus includes a spiral shaped deflector member 10 in the form of a helix made by twisting a flat bar of aluminum, stainless steel or other metal into a helical shape with a plurality of turns or revolutions about a longitudinal axis 11. While short helical deflector members of a few turns may be self-supporting, longer ones of many turns are not. In order to provide more support for the deflector member the opposite ends 12 of such deflector member are attached by welding to a pair of metal support rings 14. Three or more straight metal support rods 16 are welded to the sides of the deflector member 10 at their points of tangency with such deflector member. The ends of the rods 16 extend through openings 18 in the support rings 14 and are secured thereto in any suitable manner such as by welding. Intermediate support rings (not shown) similar to rings 14 can also be provided between the pair of end support rings and welded to the deflector member 10 and support rods 16.

As shown in FIG. 2, the deflector member 10 can be supported within a fluid conduit 20 through which a gas, such as hot air, or a liquid, such as hot water, flows substantially parallel to the axis 11 of such deflector member. Deflector member 10 deflects the fluid stream and creates turbulence within such stream to provide more uniform temperature within the fluid without creating significant resistence to flow and resulting back pressure. Thus, the fluid of higher temperature which tends to flow near the axis 22 of the conduit 20 is mixed with the fluid of lower temperature tending to flow near the inner surface of the conduit due to laminar fluid flow. This mixing produces a fluid of more uniform temperature which is higher in temperature at the inner surface of the conduit than the fluid would be without the deflector member. As a result, in the heat of a fluid flowing through conduit 20 it is more efficiently transferred to the walls of the conduit so it can be conducted to another fluid surrounding such conduit. The heat exchanger apparatus of FIG. 2 can be provided within a kettle used for heating a liquid such as that used for calcining gypsum to produce gypsum powder used for wallboard.

Another embodiment of a heat exchanger apparatus in accordance with the invention is shown in FIG. 3 which is similar to that of FIG. 2 except that three helical deflector members 10 of smaller diameter are positioned inside of the conduit 20 with their longitudinal axes 11 spaced laterally from and extending substantially parallel to the longitudinal axis 22 of the conduit. In the embodiment of FIG. 2 the longitudinal axis 11 of the deflector member 10 is substantially coaxial with the conduit axis 22 so that there is a central region substantially coextensive with the conduit axis 22 where there is little mixing of the fluid. However, in the embodiment of FIG. 3, this is avoided because the three deflector members 10 all deflect the fluid through the region of the conduit axis 22.

All three of the helical deflector members 10 in FIG. 3 are twisted in the same direction so that they create a spiral flow of the fluid in conduit 20. Each spiral flow of the deflectors mixes in the middle of the conduit thereby causing the colder air on the outside to mix with the hotter air in the center of the conduit and thereby evening out the temperature so that the resulting uniform temperature fluid produces an even hotter temperature near the inner surface of the conduit 20 than that of FIG. 2. Because of the helical shape of the deflector members, the pressure drop produced in the conduit 20 is very low, while the efficiency of the heat exchanger is increased. Thus, in the calcining kettle the heating efficiency is increased at least 8 percent while the temperature drop along the conduit is reduced to about 100° F.

In the embodiment of FIG. 3 the deflector members 10 each may have three supporting rods like the assembly of FIG. 1. However, it may be preferable to provide the three deflector members as an integral unit in which case three common inner support rods 16A are each welded to a pair of deflector members thereby reducing to six the number of support rods required. Also, the support ring 14 can be replaced by a single ring of larger diameter which is attached only to the three outer support rods 16B.

Another embodiment of a heat exchanger apparatus is shown in FIG. 4 and includes three deflector members 10 which are each attached by welds 24 at their points of tangency to the outer surface of the conduit 20 in heat exchanging relationship thereto. Hot air, steam, hot water or other heated fluid is transmitted through the conduit 20 of FIG. 4 and the heat therein is conducted from such conduit through the welds 24 to the heat exchanger members 10. The second fluid which is to be heated flows along the outer surfaces of the conduit 20 and of the helical heat exchanger members 10 which increase the area of surface contact to heat such second fluid. Thus, the external deflector members 10 act somewhat in the manner of cooling fins which are attached to steam pipes. However, unlike such fins, the helical deflector members 10 do not create appreciable resistence to fluid flow and therefore do not cause appreciable pressure drop. Any number of deflectors 10 can be secured to the outside of conduit 20 by welding or other fastening including a mechanical fit friction or combination thereof.

In all three embodiments of FIGS. 2, 3 and 4 the fluid flowing through the deflector members 10 flows in a direction substantially parallel to the longitudinal axis 11 of such deflector member. However, in FIG. 4 the fluid flow can also be substantially perpendicular to the axes 11. As a result, the deflector member deflects the fluid radially outward preventing laminar fluid flow and causing greater mixing of the fluid due to turbulence. In the embodiment of FIG. 4, the fluid flow flowing over the outside of the conduit 20 and over the surfaces of the deflector member 10 may be a liquid, a gas, or a flowable solid particulate material. The particulate material flowing over the external deflectors of FIG. 4 may be gypsum powder, in order to dry such powder. In this case, the deflector is actually a heat exchanger member, rather than a fluid deflector. A rotating drum may be used surrounding a plurality of heat exchangers similar to that of FIG. 4 which would extend through such drum parallel to its axis of rotation. In this embodiment the particulate material may flow in an axial direction opposite to the hot air or other heating fluid flowing through conduit 20 for most efficient drying. Alternatively, if the particulate material is not carried in an airstream, it can be allowed to fall by gravity downward past the deflectors 10 in a direction substantially perpendicular to the axis 11 of such deflectors.

It should be noted that the deflector members 10 in the embodiment of FIG. 3 are of smaller diameter than that of FIG. 2 when the same diameter conduit is employed. For example, for a conduit 20 having an inner diameter of 10 inches, the deflector members 10 employed in the embodiment of FIG. 3 may have an outer diameter of about 4½ inches.

The longitudinal flow of the fluid in a direction substantially parallel to the longitudinal axis 11 of the deflector member 10, as occurs in the embodiments of FIGS. 2 and 3, is shown by flow arrows 26 in FIG. 1. It should be noted that the upper flow 26 above axis 11 strikes the upper surface of one of the turns of the deflector members 10 and is deflected upward in the direction of flow arrow 26A. However, when the lower flow arrow below axis 11 strikes the bottom surface of such deflector member 10 it is deflected downward as shown by flow arrow 26B.

A fourth embodiment of the present invention is the sheet dryer apparatus shown in FIGS. 5, 6 and 7. Such dryer apparatus includes a plurality of fluid flow deflector members 10 supported within a first dryer chamber 28 and a second dryer chamber 30. Sheet material 32, such as wood veneer strips, are transmitted by a plurality of conveyor decks from an input section 34 left to right through dryer sections 28 and 30 to an output section 36 where the dried sheet material is discharged from the drying apparatus. Hot air and/or superheated steam may be used as the heating fluid which flows in the direction of arrows 38 from left to right through the first dryer section 28 and flows in the opposite direction from right to left through dryer section 30. The wood veneer sheet dryer shown in FIGS. 5, 6, and 7 is similar to that described in my earlier U.S. Pat. Nos. 4,026,037 and 4,127,946 of A. Buchholz whose disclosure is hereby incorporated by reference, so that the operation of such veneer dryer will not be described in detail since it can be learned from such earlier patents.

The drying air used in dryer sections 28 and 30 is heated by steam pipes 40 provided in a separate heat section positioned in supply conduit 42 outside of the dryer sections above the first dryer section 28. After heating, the heated air is sucked through a fan 44 at the output of conduit 42 and blown down into the front end of the first dryer section 28. The heated air flows left to right and is transmitted from the output of dryer section 28 upward through a connector section 48 into another supply conduit 46 above the second heating section 30. The heated air in supply conduit 46 is then sucked through a second fan 50 and blown back down into the output of the second dryer section 30. The heated air flows right to left in the second dryer section. When the heated air reaches the left end of the dryer section 30 it is transmitted up through a connecting conduit 52 into the first supply conduit 42. Thus, the heating gas makes a figure 8 shape trip through the dryer apparatus. A negative pressure below atmospheric pressure is maintained within the dryer sections 28 and 30 so that any pollutants, such as hydrocarbon gas or other fugitive gas emissions from such dryer sections, are avoided and instead exhausted to the atmosphere through exhaust stacks 54 and 56 at the opposite ends of the dryer apparatus.

As shown in FIG. 6 a portion of the second dryer section 30 includes a plurality of conveyors each consisting of pairs of top and bottom rollers 58 and 60. The sheet materials 32 are transmitted by the conveyors from left to right between conveyor rollers 58 and 60 engaging the top and bottom surfaces, respectively, of such sheets. A plurality of decks of conveyor rollers are provided to transmit an equal number of vertically spaced sheets 32 through such conveyor decks in each dryer section. A row of auxiliary heating steam coils 62 may be provided between each adjacent pair of conveyor decks to provide supplemental heating of the drying air flowing therebetween. The heating coils 62 may be similar to the main heating coils 40.

A plurality of fluid flow deflector members 10 are provided in the space between the adjacent decks of conveyor rolls. The helical deflector members 10 may be supported similar to the deflector units shown in FIG. 1, but with their longitudinal axes 11 substantially perpendicular to the direction of flow 38 of the hot air or steam or other heating fluid. The deflector members 10 deflect a portion of the hot air stream 38 upward as indicated by arrow 38A into contact with the bottom of upper sheet 32A and deflect another portion of such hot air downward as indicated by arrow 38B into contact with the top of the lower sheet 32B. Since the helical deflector members 10 do not provide any appreciable resistance to flow of the heating fluid, they do not cause any significant drop in pressure along the length of the dryer sections. However, the deflector members 10 do provide the advantage of creating greater turbulence in the heating fluid and better mixing from top to bottom of such fluid flowing between adjacent conveyor decks and thereby preventing laminar flow of such heating. As a result, the temperature of the heating fluid flowing between adjacent decks is maintained substantially uniform and there is better mixing of air flow between decks as more clearly shown in FIG. 7 by arrows 64. Therefore, the temperature of the heating fluid which contacts the upper and lower surfaces of the sheet material 32 is more uniform in the dryer apparatus of the present invention and is of a higher temperature than in previous apparatus not employing such helical deflector members. The result is a more efficient drying operation and the dried sheets are a better quality product with a more uniform moisture content.

In the embodiment shown in FIG. 6 with conveyor rollers 58 and 60 of 4 inches diameter and the sheets 32A and 32B spaced apart about 15 inches, the helical deflector members 10 are about 3 inches diameter and are positioned above and below the row of steam coils 62 between every other pair of rollers in a staggered spacing. However, in some cases when hot air rather than steam is employed as the heating fluid, the auxiliary heating coils 62 are eliminated in which case a single row of larger fluid flow deflectors 10 of about 4½ inches diameter may be employed between two adjacent conveyor decks.

As shown in FIG. 7 the opposite ends of the conveyor rolls 58 and 60 are mounted by rotary bushings 70 supported on vertical frame members 66. The frame member 66 is provided with openings 68 between the adjacent conveyor decks to enable the flow of heating fluid between decks as indicated by arrows 64. This provides the heating fluid with a more uniform temperature at all decks. In addition, the deflector members 10 provide more uniform mixing of the heating air from top to bottom in the space between adjacent decks so that the temperature of the heating air on the bottom surface of sheet 32A is more nearly the same as the temperature of the heating air which contacts the top surface of the sheet 32B.

It should be noted that while two rollers 58 and 60 and their associated bearings 70 are employed for each conveyor in the veneer dryer apparatus of FIGS. 5, 6 and 7, it is possible to eliminate the top rollers 58 and their associate bearings when drying gypsum wallboard, wood particle board or other self-supporting sheet material instead of wood veneer. However, the operation of the deflector members 10 is the same. By virtue of the continuous spiral shape of the heclical deflector member 10, there is more turbulence and better mixing along its entire length. Also, because of the reduced resistence to flow and small pressure drop in the dryer sections resulting from use of the helical deflector 10, the flow of the heating gas through such dryer sections can be increased over that produced in my earlier U.S. Pat. No. 4,121,350.

It will be obvious to those having ordinary skill in the art that many other changes may be made in the above-discussed preferred embodiments without departing from the spirit of the invention. Therefore, the scope of the present invention should be determined only by the following claims.

I claim:

1. A sheet dryer apparatus for removing water absorbed in sheet material, comprising:

dryer means including at least one drying chamber, for drying sheet material as it is moved through said chamber;

conveyor means for conveying said sheet material through said chamber, including first and second conveyors for conveying first and second sheets in spaced relationship to each other;

heating means for providing heating fluid within said drying chamber including a first stream of heating fluid flowing primarily in one direction between said first and second conveyors; and deflector means including a first set of helical deflector members supported between said first and second sheets with the longitudinal axes of the deflector members extending transversely to said one direction of flow of said first stream, for deflecting said first stream of heating fluid with each deflector member in a first direction into contact with said first sheet and in another direction into contact with said second sheet and for mixing the heating fluid for more uniform drying.

2. Drying apparatus in accordance with claim 1 in which the drying fluid is heated air or steam.

3. Drying apparatus in accordance with claim 1 in which the helical deflector members are each supported with their longitudinal axis substantially perpendicular to the flow of said first stream.

4. Drying apparatus in accordance with claim 1 in which the dryer means is a veneer dryer and the sheet material is wood veneer.

5. Drying apparatus in accordance with claim 4 which also includes second and third sets of helical deflector members positioned on the opposite sides of said first and second sheets from said first set of deflector members, and the heating means provides second and third streams of heating fluid on said opposite sides of the first and second sheets so they are deflected into contact with said sheets by said second and third sets of deflector members.

6. Drying apparatus in accordance with claim 1 in which each helical deflector member is a strip of metal twisted into a helix about its longitudinal axis.

7. Drying apparatus in accordance with claim 6 in which the sides of the deflector members are attached to support rods extending substantially parallel to said axis.

8. Drying apparatus in accordance with claim 7 in which annular support rings surrounding the deflector member are attached at positions spaced longitudinally along said deflector member.

9. Fluid flow deflector apparatus for heating an object comprising:

deflector means for deflecting fluid flow, including a plurality of deflector members of spiral shape having a longitudinal axis; and support means for supporting each of said deflector members in the path of a fluid stream of a heating fluid flowing primarily toward said deflector members with its axis extending substantially perpendicular to the direction of flow of said fluid stream to deflect the flow of said fluid stream toward the object being heated and to mix the heating fluid for more uniform heating.

10. Deflector apparatus in accordance with claim 9 in which the deflector means includes a plurality of deflector members supported between a pair of conveyor means for conveying sheet material, said deflector members deflecting portions of a stream of drying gas upward against a first sheet and downward against a second sheet carried by different ones of said pair of conveyor means to dry said sheets.

11. Deflector apparatus in accordance with claim 9 in which the deflector member is of a helical shape.

12. Deflector apparatus in accordance with claim 11 in which the deflector member is a strip member twisted into a helix about its longitudinal axis.

13. Deflector apparatus in accordance with claim 9 in which the support means includes a plurality of support rods fixedly attached to the sides of said deflector member and extending substantially parallel to its axis.

14. Deflector apparatus in accordance with claim 13 in which the support means includes support rings surrounding said deflector member and fixedly attached at positions spaced longitudinally along said deflector member.

* * * * *